United States Patent [19]

Rae

[11] 4,290,286

[45] Sep. 22, 1981

[54] COMBINATION LOCK

[76] Inventor: Andrew E. Rae, 103 Cumberland Ave., Willow Park, Guilford, Surrey, England

[21] Appl. No.: 92,290

[22] Filed: Nov. 8, 1979

[30] Foreign Application Priority Data

Nov. 14, 1978 [GB] United Kingdom ..... 44324/78

[51] Int. Cl.[3] ..... E05B 37/02

[52] U.S. Cl. ..... 70/285; 70/288; 70/310; 70/311; 70/312; 70/315

[58] Field of Search ..... 70/285, 287, 288, 310, 70/311, 312, 315, 324, 327, 328

[56] References Cited

U.S. PATENT DOCUMENTS 982,125 1/1911 Chapman ..... 70/285

FOREIGN PATENT DOCUMENTS 781829 3/1935 France ..... 70/288

791559 9/1935 France ..... 70/288

*Primary Examiner*—Robert L. Wolfe

*Attorney, Agent, or Firm*—Fleit & Jacobson

[57] ABSTRACT

A combination lock comprising at least two coaxially arranged elongate members, first and second rotatable combination dial members for each elongate member, an abutment member on each elongate member, a bolt which is adapted to slide backwards and forwards in the direction of alignment of the elongate members, and a bolt-operating member, each first combination dial member being fixed to its elongate member and each second combination dial member being rotatable with respect to its elongate member, and each second combination dial member having a central aperture for receiving the elongate member and a slot for receiving the abutment member, the combination lock being such that when the code set on all the second rotatable combination dial members agrees with the code set on all the first rotatable combination dial members each abutment member can move into the slot on its second combination dial member to allow each elongate member to move through its second member for allowing withdrawal of the bolt, and the combination lock including locking means which is spring biased into engagement with the first rotatable combination dial members and which prevents unintended rotational movement of the first rotatable dial members and therefore unintended loss of the code set on the first combination dial members while permitting backwards and forwards movement of the first combination dial members when the elongate members are moved backwards and forwards through the second combination dial members.

12 Claims, 6 Drawing Figures

COMBINATION LOCK

This invention relates to a combination lock.

Accordingly, this invention provides a combination lock comprising at least two coaxially arranged elongate members, first and second rotatable combination dial members for each elongate member, an abutment member on each elongate member, a bolt which is adapted to slide backwards and forwards in the direction of alignment of the elongate members, and a bolt-operating member, each first combination dial member being fixed to its elongate member and each second combination dial member being rotatable with respect to its elongate member, and each second combination dial member having a central aperture for receiving the elongate member and a slot for receiving the abutment member, the combination lock being such that when the code set on all the second rotatable combination dial members agrees with the code set on all the first rotatable combination dial members each abutment member can move into the slot on its second combination dial member to allow each elongate member to move through its second member for allowing withdrawal of the bolt, and the combination lock including locking means which is spring biased into engagement with the first rotatable combination dial members and which prevents unintended rotational movement of the first rotatable dial members and therefore unintended loss of the code set on the first combination dial members whilst permitting backwards and forwards movement of the first combination dial members when the elongate members are moved backwards and forwards through the second combination dial members.

The combination lock of the invention may be used on public storage lockers such for example as in sports halls, railway stations, bus depots, clubs, swimming pools, airport terminals and business and factory staff rooms. The combination lock may eliminate the need for users of the lockers to have keys and it may also reduce the number of maintenance staff required. It is envisaged that a user of a locker having the combination lock of the invention could set a code on the first rotatable combination dial members and could then lock the locker. The locker could then only be opened by the user of the locker correctly dialing the chosen code on the second rotatable combination dial members. A different subsequent user of the locker could then set a different code in the first rotatable combination dial members.

The combination locks can also be used to replace conventional locks on existing lockers and they can also be used in situations other than on lockers.

The first and second rotatable combination dial members will usually have numbers or letters on them for setting number or letter codes.

Each first combination dial member may be formed separately from its elongate member and subsequently joined to its elongate member. Alternatively, if desired, each first combination dial member may be formed as an integral part of its elongate member.

Each second combination dial member may have a plurality of depressions into which the abutment member will temporarily go as each of the second combination dial members is rotated until the abutment member enters the slot, the combination lock being such that a person rotating each of the second combination dial members can feel the abutment member going into the depressions and the slot but cannot feel any substantial difference between the abutment member going into the depressions and the abutment member going into the slot. The depressions thus act to prevent a potential thief manipulating the second combination dial members and trying to feel the correct combination code and thus open the combination lock without authority.

Advantageously, the bolt is connected to the innermost elongate member by a spring arrangement, the spring arrangement causing the bolt to move longitudinally when the innermost elongate member is moved longitudinally whilst biasing the bolt away from the innermost elongate member to allow the bolt to engage in a keeper and so close the combination lock irrespective of whether or not the code set on all the first rotatable combination dial members agrees with the code set on all the second rotatable combination dial members.

The first and second rotatable combination dial members may be biased apart by a spring which insures that the abutment members disengage from the slots in their second combination dial members when the bolt-operating member is not being operated to move the bolt.

The bolt-operating member may be connected to the innermost elongate member by a spring and a slipper member, the slipper member allowing the innermost elongate member to be rotated without rotating the spring.

Usually, the bolt-operating member is manually operable backwards and forwards in the direction of alignment of the elongate members. If desired, other types of bolt-operating member may be employed. Thus, for example, the bolt-operating member may include a solenoid, in which case the bolt-operating member will be an electrically-operated bolt-operating member. Further, if desired, the bolt-operating member could activate an appropriate hydraulic or pneumatic circuit for effecting movement of the bolt.

The locking means may be a locking bar, the locking bar having a gripper portion for enabling the locking bar to be gripped and pulled out of engagement with the first combination dial members when it is desired to set a new code on the first combination dial members. The locking means may also be, for example, two or more spring biased bracket members or a single spring biased roller bar.

Preferably, each of the abutment members is a pin.

Also preferably, the combination lock is such that there are three coaxially arranged elongate members, three first rotatable combination dial members, and three second rotatable combination dial members.

The first combination dial members may be adapted to be engaged from the inside of a door and the second combination dial members may be adapted to be engaged from the exterior of the door.

The combination lock may include a key-operated mechanism for operating the bolt irrespective of the codes set on the first and second combination dial members.

Embodiments of the invention will now be described solely by way of example and with reference to the accompanying drawings in which.

Figure 1:
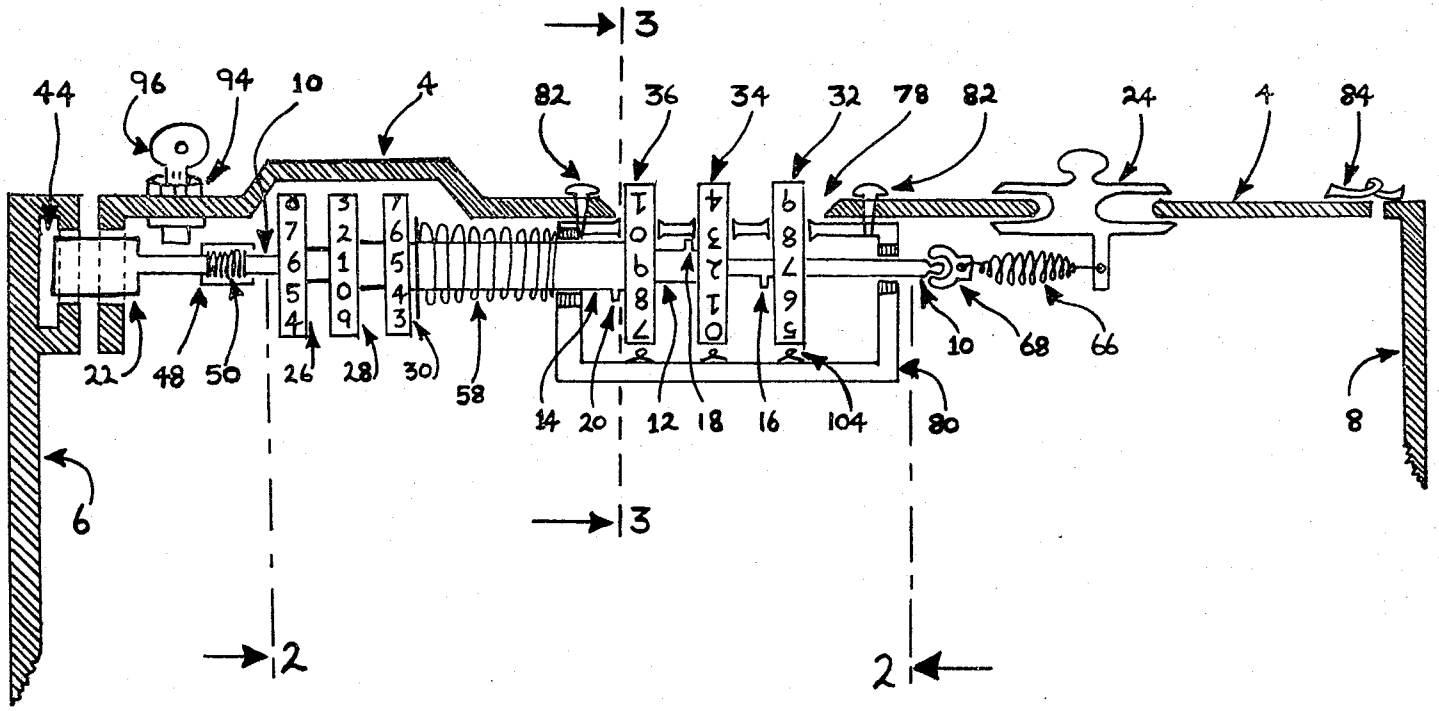
FIG. 1 is a part sectional part plan view of a combination lock in acordance with the invention.

Referring to FIGS. 1 to 5, there is shown a combination lock 2 fitted to a door 4 of a locker having side walls 6, 8 as illustrated.

The combination lock 2 comprises three coaxially arranged elongate members 10, 12, 14. The innermost elongate member 10 is in the form of a rod whilst the elongate members 12, 14 are in the form of tubes. An abutment member in the form of a pin 16, 18, 20 is provided on each elongate member 10, 12, 14 respectively. The combination lock 2 further comprises a bolt 22 which is adapted to slide backwards and forwards in the direction of alignment of the elongate members 10, 12, 14 as illustrated. The bolt 22 is operated in a manner as will be described hereinbelow by a bolt-operating member 24.

Figure 2:
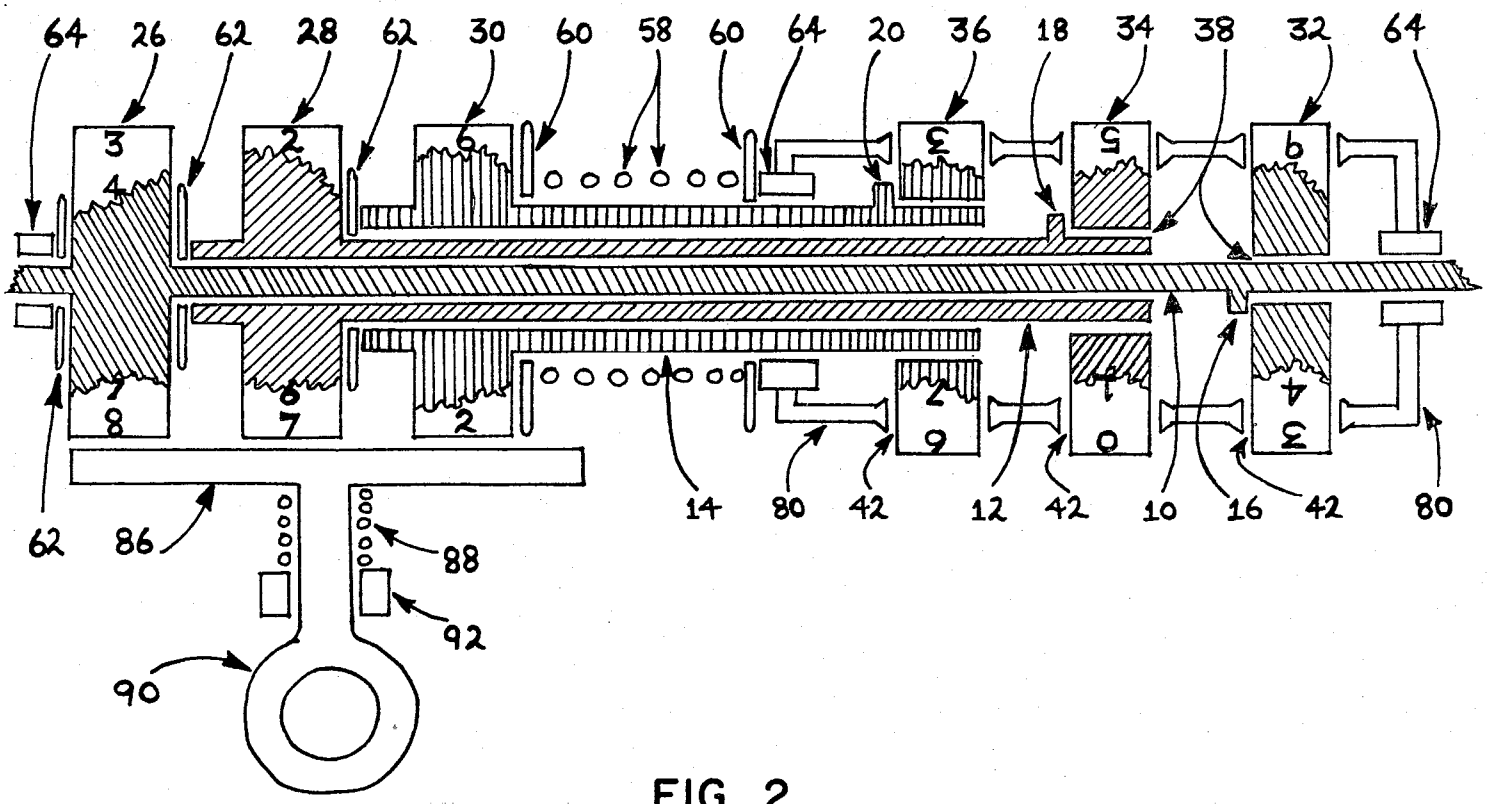
FIG. 2 is an enlarged section of part of the lock illustrated in FIG. 1.
Figure 4:
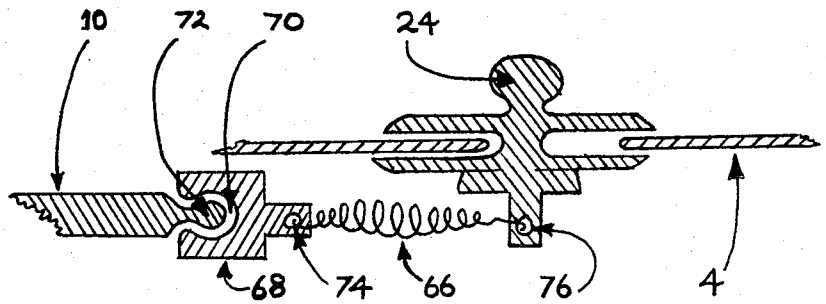
FIG. 4 is an enlarged section of another part of the combination lock shown in FIG. 1.

First rotatable combination dial members 26, 28, 30 are formed on and fixed to the elongate members 10, 12, 14 respectively. Second rotatable combination dial members 32, 34, 36 are positioned over the elongate members 10, 12, 14 respectively and these second combination dial members 32, 34, 36 are spaced from the elongate members 10, 12, 14 as is illustrated in FIG. 2 so that the second combination dial members 32, 34, 36 can rotate with respect to the elongate members 10, 12, 14.

Each second combination dial member 32, 34, 36 is provided with a central aperture 38 through which the elongate members 10, 12, 14 slide. Each second combination dial member 32, 34, 36 is also provided with a slot 40 for receiving one of the pins 16, 18, 20.

The combination lock 2 is such that the elongate members 10, 12, 14 are prevented from moving through the apertures 38 in the second combination dial members 32, 34, 36 by virtue of the pins 16, 18, 20 engaging the rim 42 of the second combination dial members 32, 34, 36. It is only when the second combination dial members 32, 34, 36 are correctly rotated to form a code which is the same as a code previously set on the first combination dial members 26, 28, 30 that the slots 40 will be correctly aligned with the pins 16, 18, 20 such that all three elongate members 10, 12, 14 can be pulled through the apertures 38 in the second combination dial members 32, 34, 36 by sliding the bolt-operating member 24 to the right as shown in FIG. 1, the bolt 22 being moved out of its keeper slot 44 in the wall 6 of the locker. The door 2 of the locker can then be opened.

Figure 3:
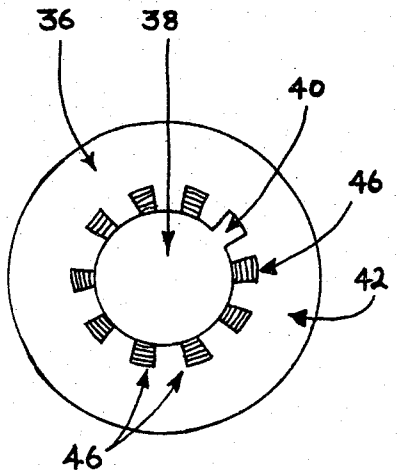
FIG. 3 is an enlarged section on the line 3—3 shown in FIG. 1.

It will be noticed from FIG. 3 that the rim 42 of the second combination dial member 32 is provided with a plurality of depressions 46 which act as blank slots. The second combination dial members 34, 36 are similarly constructed with depressions 46. The pins 16, 18, 20 temporarily go into the depressions 46 as the second combination dial members 32, 34, 36 are rotated until such time as the slots 40 are correctly aligned with the pins 16, 18, 20. A person rotating the second combination dial members 32, 34, 36 can feel the pins 16, 18, 20 going into the depressions 46 and the slot 40 but the person should not be able to feel any substantial difference between the pins 16, 18, 20 going into the depressions 46 and into the slot 40. This will thus prevent the person from trying to feel which is the correct combination to open the combination lock 2.

The bolt 22 is connected to the innermost elongate member 10 by a spring arrangement 48. This spring arrangement 48 is shown most clearly in FIG. 5. The spring arrangement 48 comprises a spring 50 which is located in a housing 52. The elongate member 10 fixed in the housing 52 by a cir-clip 54. The bolt 22 has a shank 56 which is provided with a pair of cir-clips 54. The cir-clips 54 effectively connect the shank 56 of the bolt 22 to the housing 52. The spring arrangement 48 effectively provides a connecting arrangement between the bolt 22 and the elongate member 10. Thus, the spring arrangement 48 causes the bolt 22 to move longitudinally when the elogate member 10 is moved longitudinally. The spring arrangement 48 also biases the bolt 22 away from the longitudinal member 10 to allow the bolt 22 to engage in the keeper slot 44 and so close the door 4 irrespective of whether or not the code set on all the first rotatable combination dial members 26, 28, 30 agrees with the code set on all the second rotatable combination dial members 32, 34, 36.

It will be seen from FIG. 1 that the first combination dial members 26, 28, 30 are biased away from the second combination dial members 32, 34, 36 by means of a spring 58 positioned around the elongate member 14. As is seen most clearly in FIG. 2, the spring 58 acts on a pair of abutment washers 60. Washers 62 are also employed adjacent the first combination dial members 26, 28, to facilitate their rotation and the elongate member 10 rotates in bushes 64. The spring 58 is effective to ensure that the pins 16, 18, 20 are biased out of engagement of the second combination dial members 32, 34, 36 when a combination has been set on the first combination dial members 26, 28, 30 and the door 4 has been closed.

When it is desired to open the combination lock 2 and the correct code has been dialed on the second combination dial members 32, 34, 36 to agree with the code previously set on the first combination dial members 26, 28, 30, then the bolt-operating member 24 can be slid to the right as mentioned above. The bolt-operating member 24 is advantageously connected to the elongate member 10 by a spring 66 and a slipper member 68. The slipper member 68 is provided with a concave recess 70 which receives a rounded head part 72 of the elongate member 10. The elongate member 10 can thus rotate when its first combination dial member 26 is being set without this rotational movement being transmitted to the bolt-operating member 24. The spring 66 locates at one end in an aperture 74 in the slipper member 68 and it locates at its other end in an aperture 76 in the bolt-operating member 24.

The door 4 is provided with an opening 78 through which the second combination dial members 32, 34, 36 project slightly. This opening 78 enables a code to be set on the second combination dial members 32, 34, 36 from outside the locker. A person standing outside the locker and altering the second combination dial members 32, 34, 36 will not be able to see the code set on the first combination dial members 26, 28, 30 since these first combination dial members 26, 28, 30 will be hidden inside the locker. Furthermore, the second combination dial members 32, 34, 36 are enclosed in a cover 80 inside the locker in order to prevent persons endeavouring to look through the opening 78 and see the code that has been pre-set on the first combination dial members 26, 28, 30. The cover 80 can be located in position on the door 4 by means of rivets 82. The door is itself hinged to the side wall 8 of the locker by means of hinges, one of which is shown as hinge 84.

The combination lock 2 is provided with locking means in the form of a locking bar 86. This bar 86 is spring biased by a spring 88 into engagement with the circumference of the first combination dial members 26, 28, 30. These first combination dial members 26, 28, 30 are advantageously provided with longitudinally extending grooves (not shown) so that, when a code is dialled in the first combination dial members 26, 28, 30, the locking bar 86 will engage in aligned grooves in each of the first combination dial members 26, 28, 30. The code thus set in the first combination dial members 26, 28, 30 will be locked in position by the locking bar 86. The first combination dial members 26, 28, 30 will thus not be able to be rotated by persons attempting to apply rotational movement to the elongate members 10, 12, 14. It will be apparent that it is undesirable for the code set in the first combination dial members 26, 28, 30 to be altered since this will prevent the correct code being dialed on the second combination dial members 32, 34, 36. When the correct code has been dialed on the second combination dial members 32, 34, 36, the locking bar 86 will still allow the first combination dial members 26, 28, 30 to slide to the right as shown in FIGS. 1 and 2 to enable the combination lock 2 to be opened. The locking bar 86 is provided with a gripper eye portion 90 which enables the locking bar 86 to be pulled against pressure of the spring 88 away from the first combination dial members 26, 28, 30 in order to set a new code on the first combination dial members 26, 28, 30 when the locker has been opened and it is desired to re-shut the locker with a new code. The spring 88 abuts at its end remote from the first combination dial members 26, 28, 30 against a collar 92.

Figure 5:
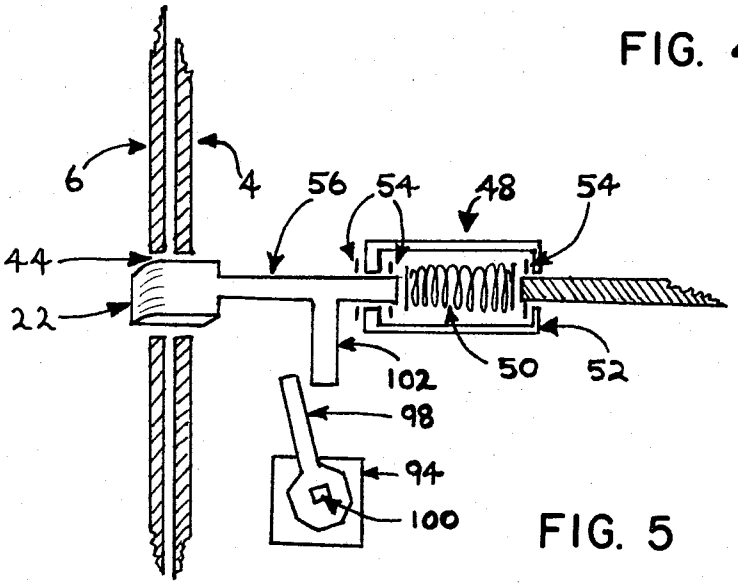
FIG. 5 is an enlarged section of yet another part of the combination lock shown in FIG. 1 and looking from the rear.

In case a user of the combination lock 2 should forget the combination set on the first combination dial members 26, 28, 30 and should therefore be unable to open the combination lock 2 by correctly dialing the combination code on the second combination dial members 32, 34, 36, the combination lock 2 is provided with a key-operated mechanism 94 for operating the bolt 25 irrespective of the codes set on the first and second combination dial members. The mechanism 94 is operated by a key 96. When the key 96 is turned, it causes a lever 98 to pivot about a pivot 100 and engage an arm 102 on the shank 56 of the bolt 22. Further rotation of the lever 98 moves the arm 102 and therefore the bolt 22 to the right as shown in FIG. 5.

In order that a person operating the second combination dial members 32, 34, 36 should be able to feel that the second combination dial member 32, 34, 36 are being turned from one number to another, the inside of the cover 80 is advantageously provided with indexing devices 104 which may simply be springs engaging the periphery of the second combination dial members 32, 34, 36. The periphery of the second combination dial members 32, 34, 36 is advantageously notched or otherwise recessed to provide index points for engaging the indexing devices 104.

Figure 6:
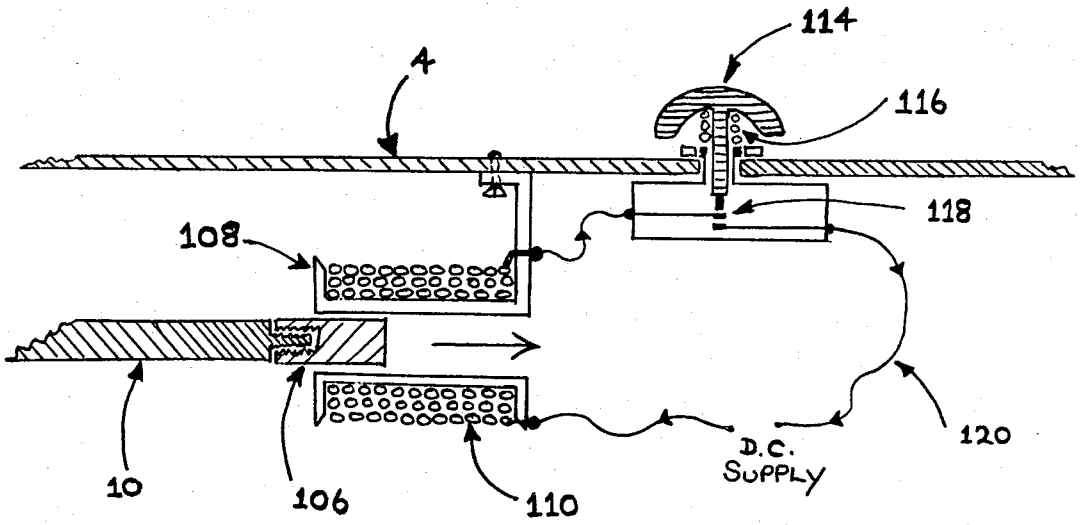
FIG. 6 shows an alternative arrangement to that illustrated in FIG. 4.

In FIGS. 1 to 5, the bolt-operating member 24 is manually moved. In FIG. 6, the elongate member 10 is shown provided with a magnetic end portion 106. This portion 106 forms part of a solenoid 108 having a coil 110. The coil can be mains or battery operated from a power source which can be switched on by a control button 114. When current passes through the coil 110, the portion 106 is drawn into the coil 110 and is therefore moved to the right as shown in FIG. 6. This moves the elongate member 10 to the right to open the combination lock 2 in the same manner as has been described above.

It is to be appreciated that the embodiments of the invention described above have been given by way of example only and that modifications may be effected. Thus, for example, a hydraulic or pneumatic arrangement employing rams or pistons could be employed for opening the bolt 24. Furthermore, with an electrically operated combination lock in accordance with the invention, the pins 16, 18, 20 may be arranged to form an electrical path with appropriate parts of the second combination dial members 32, 34, 36. When the various parts of the combination lock 2 are appropriately aligned, current can be arranged to pass through the various lock parts to cause a circuit to be completed and operate a solenoid which would withdraw the bolt. With the electrical circuit, it can be arranged that the elongate members 10, 12, 14 do not have to move through the second combination dial members 32, 34, 36.

I claim:

1. A combination lock comprising at least two coaxially arranged elongate members, first and second rotatable combination dial members for each elongate member, an abutment member on each elongate member, a bolt which is adapted to slide backwards and forwards in the direction of alignment of the elongate members, and a bolt-operating member, each first combination dial member being fixed to its elongate member and each second combination dial member being rotatable with respect to its elongate member, and each second combination dial member having a central aperture for receiving the elongate member and a slot for receiving the abutment member, the combination lock being such that when the code set on all the second rotatable combination dial members agrees with the code set on all the first rotatable combination dial members each abutment member can move into the slot on its second combination dial member to allow each elongate member to move through its second member for allowing withdrawal of the bolt, and the combination lock including locking means which is spring biased into engagement with the first rotatable combination dial members and which prevents unintended rotational movement of the first rotatable dial members and therefore unintended loss of the code set on the first combination dial members whilst permitting backwards and forwards movement of the first combination dial members when the elongate members are moved backwards and forwards through the second combination dial members.

2. A combination lock according to the claim 1 in which each second combination dial member has a plurality of depressions into which the abutment member will temporarily go as each of the second combination dial members is rotated until the abutment member enters the slot, the combination lock being such that a person rotating each of the second combination dial members can feel the abutment member going into the depressions and the slot but cannot feel any substantial difference between the abutment member going into the depressions and the abutment member going into the slot.

3. A combination lock according to claim 1 in which the bolt is connected to the innermost elongate member by a spring arrangement, the spring arrangement causing the bolt to move longitudinally when the innermost elongate member is moved longitudinally whilst biasing the bolt away from the innermost elongate member to allow the bolt to engage in a keeper and so close the combination lock irrespective of whether or not the code set on all the first rotatable combination dial members agrees with the code set on all the second rotatable combination dial members.

4. A combination lock according to claim 3 in which the first and second rotatable combination dial members are biased apart by a spring which ensures that the abutment members dis-engage from the slots in their second combination dial members when the bolt-operating member is not being operated to move the bolt.

5. A combination lock according to claim 4 in which the bolt-operating member is connected to the innermost elongate member by a spring and a slipper member, the slipper member allowing the innermost elongate member to be rotated without rotating the spring.

6. A combination lock according to claim 5 in which the bolt-operating member is manually operable backwards and forwards in the direction of alignment of the elongate members.

7. A combination lock according to claim 5 in which the bolt-operating member includes a solenoid and is an electrically-operated bolt-operating member.

8. A combination lock according to claim 1, claim 2 or claim 3 in which the locking means is a locking bar, the locking bar having a gripper portion for enabling the locking bar to be gripped and pulled out of engagement with the first combination dial members when it is desired to set a new code on the first combination dial members.

9. A combination lock according to claim 1, claim 2 or claim 3 in which each of the abutment members is a pin.

10. A combination lock according to claim 1, claim 2 or claim 3 in which there are three coaxially arranged elongate members, three first rotatable combination dial members, and three second rotatable combination dial members.

11. A combination lock according to claim 1, claim 2 or claim 3 in which the first combination dial members are adapted to be engaged from the inside of a door and the second combination dial members are adapted to be engaged from the exterior of the door.

12. A combination lock according to claim 1, claim 2 or claim 3 including a key-operated mechanism for operating the bolt irrespective of the codes set on the first and second dial members.

* * * * *